US006500077B1

(12) United States Patent
Wei

(10) Patent No.: US 6,500,077 B1
(45) Date of Patent: Dec. 31, 2002

(54) ROTATING TEE STRUCTURE FOR GOLF

(76) Inventor: Ming Sheng Wei, P.O. Box 82-144, Taipei (TW)

( * ) Notice: Subject to any disclaimer, the term of this patent is extended or adjusted under 35 U.S.C. 154(b) by 0 days.

(21) Appl. No.: 09/929,360

(22) Filed: Aug. 15, 2001

(51) Int. Cl.[7] ..... A63B 69/36
(52) U.S. Cl. ..... 473/397; 473/396
(58) Field of Search ..... 473/387–403

(56) References Cited

U.S. PATENT DOCUMENTS 1,839,040 A * 12/1931 McCarrier ..... 473/392
1,924,473 A * 8/1933 Walsh ..... 473/392
2,466,115 A * 4/1949 MacInnes et al. ..... 473/392
3,743,298 A * 7/1973 Reynolds ..... 473/392
4,004,814 A * 1/1977 Blair ..... 473/392

* cited by examiner

*Primary Examiner*—Steven Wong
(74) *Attorney, Agent, or Firm*—Leong C. Lei

(57) ABSTRACT

A rotating tee structure for golf is disclosed. The tee structure comprises a seat body, a rotating connector, a lifting ring, an elastic arm, a ball-holding seat and a pivotal rod, wherein the elastic arm is mounted on the body having a fixing leg and the rotating connector. One end of the elastic arm is disposed with the ball-holding seat to accommodate a golf ball. When the golf ball on the ball-holding seat is hit with a golf club, the elastic arm and the rotating connector absorb the impact force at the instance when the golf club strikes the ball.

2 Claims, 11 Drawing Sheets

ROTATING TEE STRUCTURE FOR GOLF

BACKGROUND OF THE INVENTION (a) Field of the Invention

The present invention relates to a rotating tee structure for golf, and in particular, a tee structure including a body having a rotating connector, an elastic arm, and a pivotal rod.

(b) Description of the Prior Art

A "T"-shaped tee is used to hold a golf ball before the ball is struck using a golf club in playing golf. As shown in FIG. 1, the tee structure is a body having a sharp tip at one end and a holding disc on the other end. The body is inserted into the ground to a certain height with the sharp tip of the body, and a golf ball is then placed on the holding disc before a player hits the golf ball.

In golfing, such conventional tee structure has drawbacks as follows:

(1) The tee structure is gone together with the golf ball when the ball is struck.

(2) A plurality of tees are needed for a golf match and these tees are never recovered as a result of their size, which, in turn, the tees pollute the environment.

(3) For wooden clubs, longer tees are required, and shorter tees are needed for iron clubs. Thus, a plurality of tees with different length are required for a golf game.

(4) At the instance of impaction of the golf ball with the golf club, the tee is a resistance to the ball and therefore, the distance traveled by the golf ball is affected.

Accordingly, it is an object of the present invention to provide a rotating tee structure for golf, which mitigates the above drawbacks.

SUMMARY OF THE INVENTION

A main object of the present invention is to provide a rotating tee structure for golf having a body and a rotating connector mounted on the body, characterized in that an elastic arm having an elastic compressible section is provided on the connector and one end of the elastic arm is mounted with a ball holding seat for the holding of a golf ball, thereby when the golf ball is struck with a golf club, the elastic arm and the rotating connector absorb the impact force at the instance of ball striking action and the golf ball travels further as compared to the conventional tee.

A further object of the present invention is to provide a rotating tee structure for golf, wherein the horizontal position of the tee can be slightly adjusted and the golf ball on the holding seat will firmly sit on it.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PRESENT INVENTION

Figure 1:
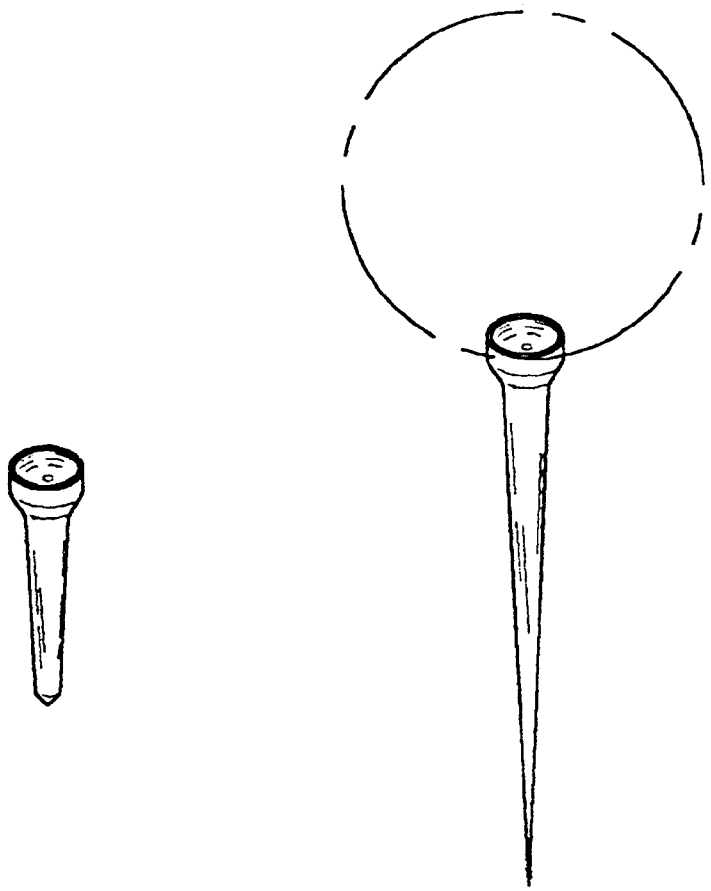
FIG. 1 (PRIOR ART)
FIG. 1 is a perspective view of a conventional tee structure utilized in golf.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, alterations and further modifications in the illustrated device, and further applications of the principles of the invention as illustrated herein being contemplated as would normally occur to one skilled in the art to which the invention relates.

Figure 2:
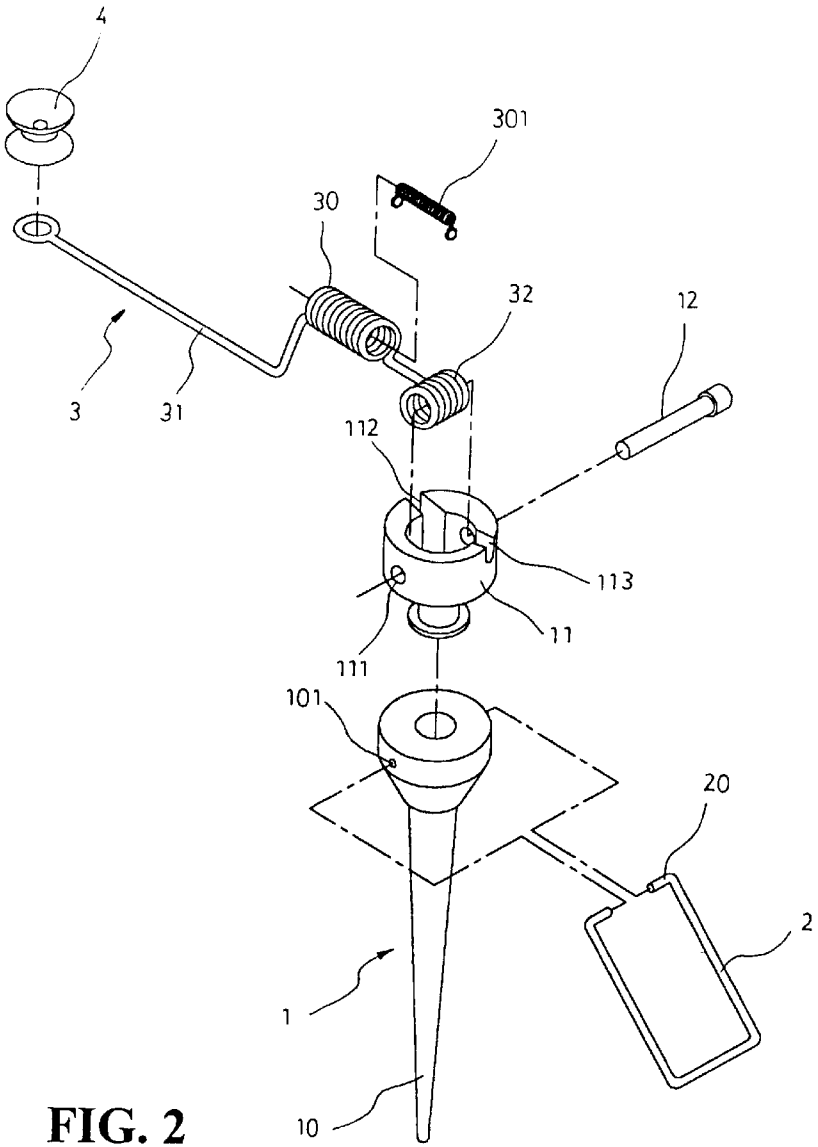
FIG. 2 is a perspective exploded view of a rotatable tee structure for gold in accordance with the present invention.
Figure 3:
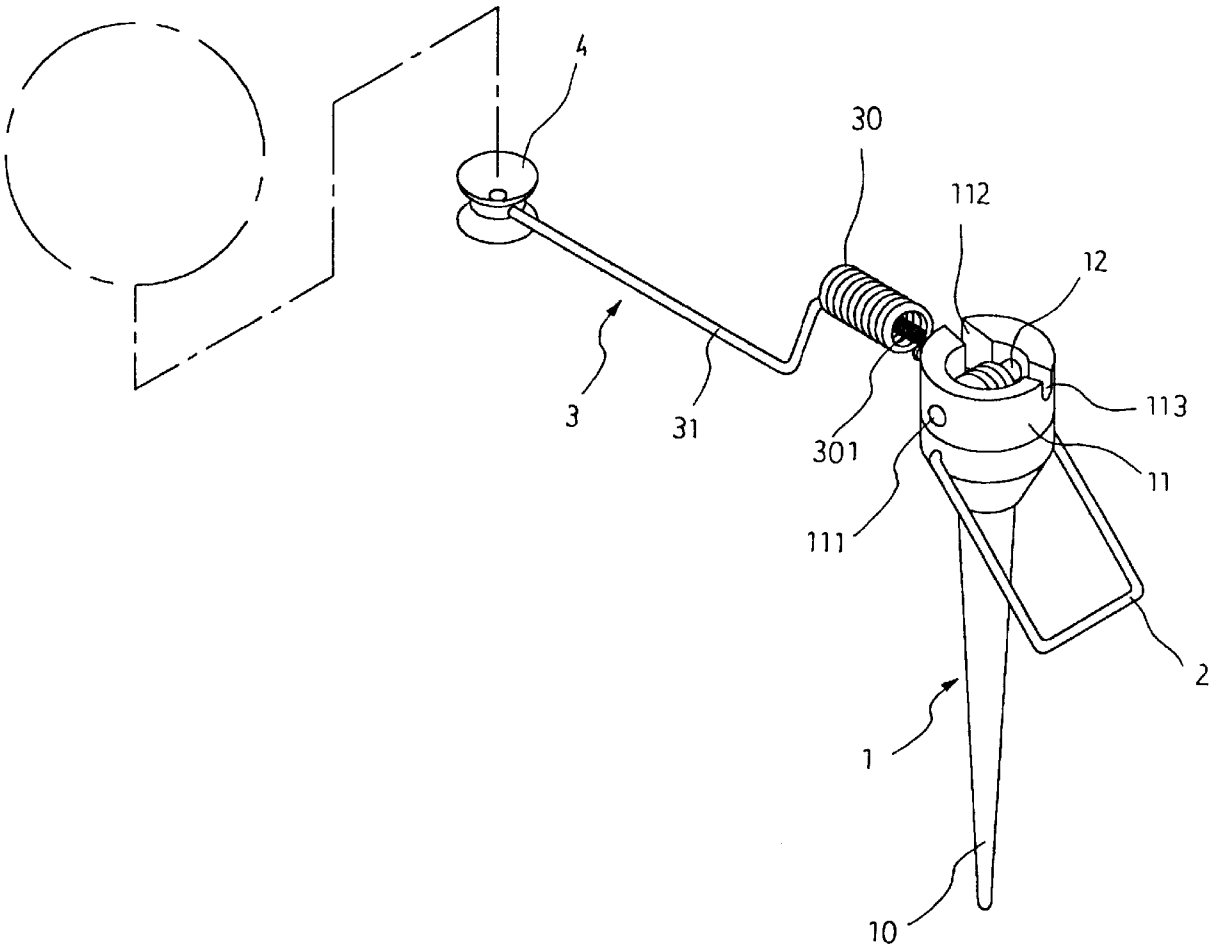
FIG. 3 is a perspective view of a rotatable golf ball tee structure in accordance with the present invention.
Figure 4:
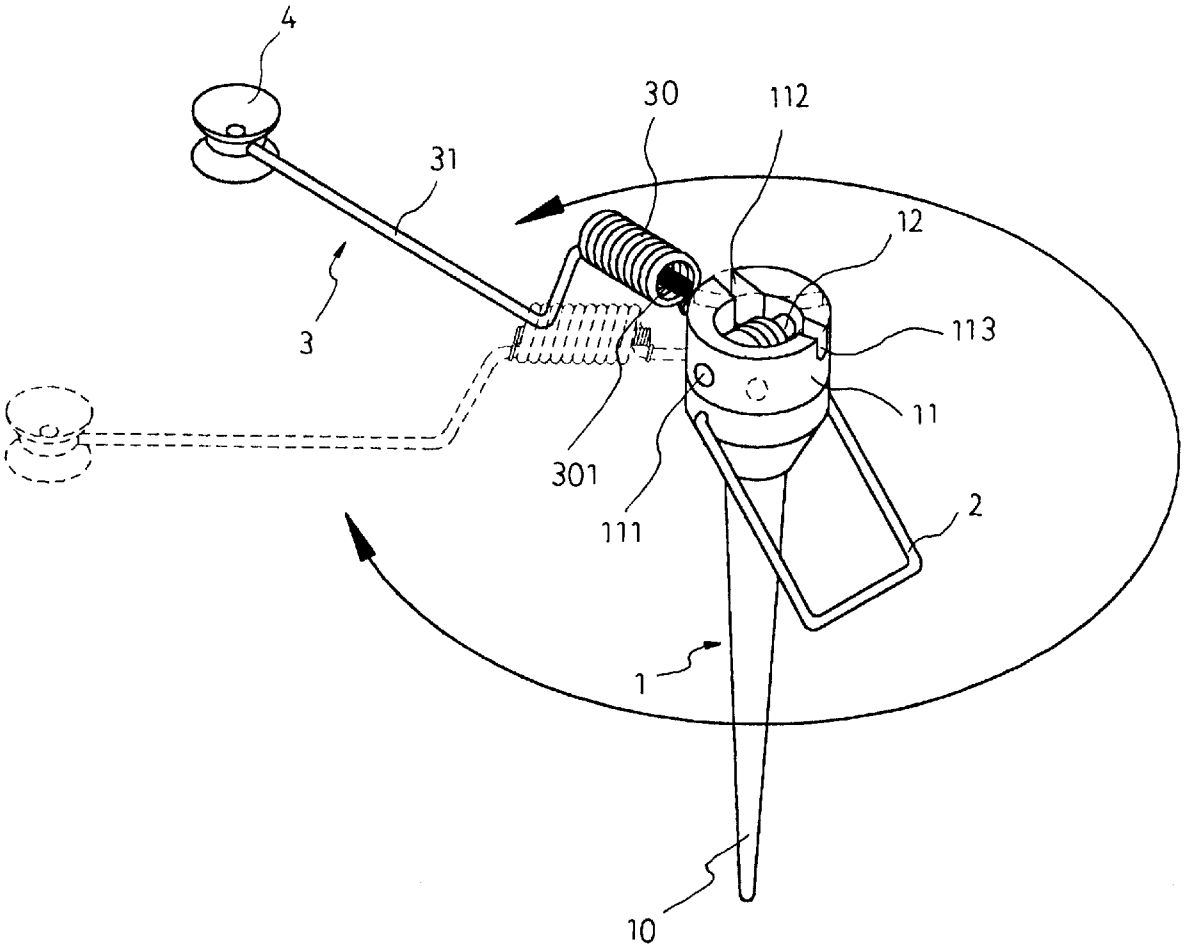
FIG. 4 is a perspective view illustrating schematically the rotating action of the golf ball tee structure in accordance with the present invention.

Referring to FIGS. 2, 3 and 4, there is shown a rotatable golf ball tee structure comprising a ball impact body 1, a lifting ring 2, an elastic arm 3 and a ball-holding seat 4. The impact body 1 is provided with a corresponding fixing leg 10 for securing the body 1 into the ground. The top of the body 1 is pivotally mounted to a rotating connector 11 which can revolve for 360 degrees. On the rotating connector 11, a connection hole 111 is provided such that a shaft rod 12 can be inserted therein, together with a mounting section 32 of an elastic arm 3. On the rotating connector 11, a large notch 112 and a small notch 113 are provided so that the elastic arm 3 can flip to left and/or left side. The elastic arm 3 is a rigid metallic wire of an appropriate hardness and formed integrally as a unit. The front end of the arm 3 is an elastic compressible section 30 and the edge thereof is a coiled mounting section 32. The elasticity of the elastic compressible section 30 can eliminate the instantaneous reaction when, the golf ball is struck with a golf club, thereby an excellent buffering effect is obtained. In order to prevent deformation of the compressible section 30 when a ball is struck, a small elastic member 301 is provided to the compressible section 30, thereby the small elastic member 301 causes the compressible section 30 to restore to its original shape when the compressible section 30 is impacted and twisted. The rear end of the elastic arm 3 is a concentric round body having mounted with the ball holding seat 4. The ball holding seat 4 is a round body being recessed at the center thereof for the placement of a golf ball. On the fixing leg 10, a pivotal hole 101 is provided which is directly joined to a pivotal head 20 of the lifting ring 2, so that the tee structure can be easily lifted up.

Figure 5:
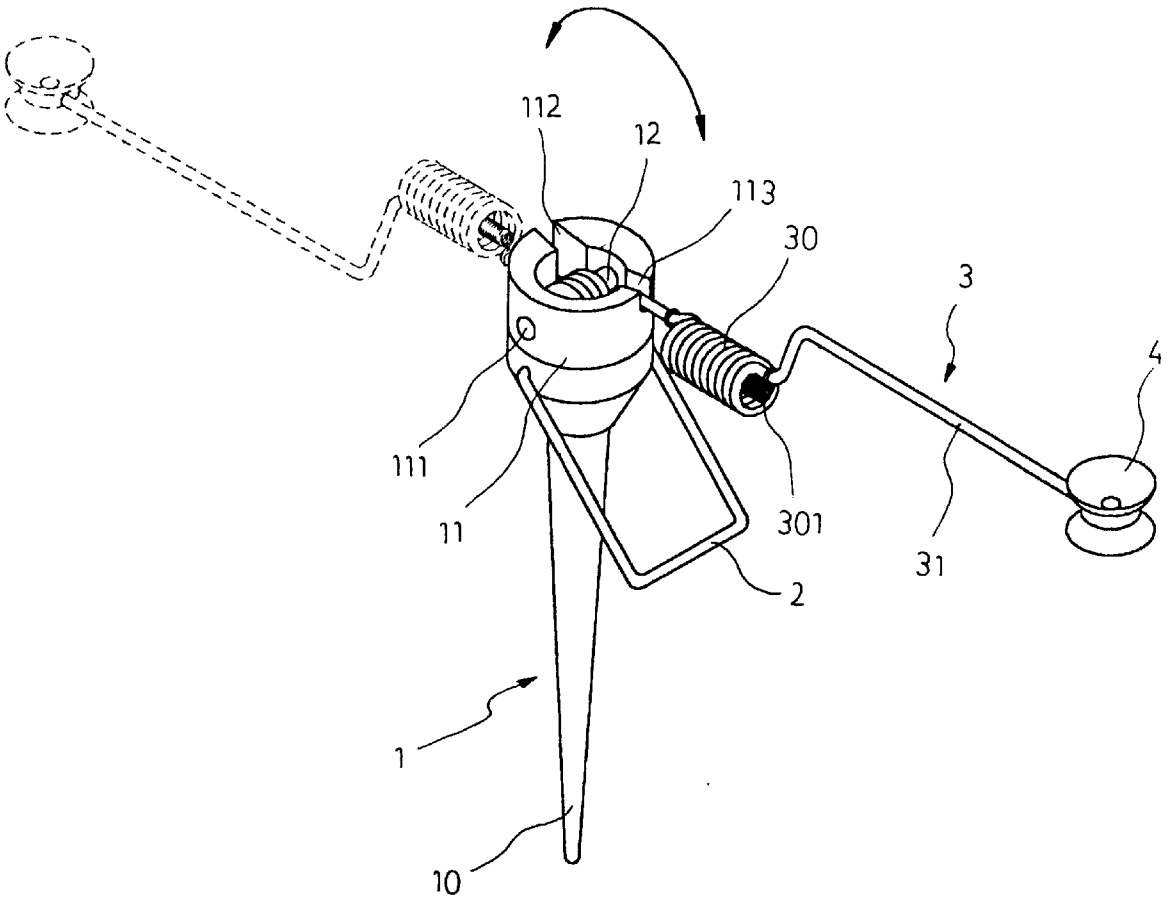
FIG. 5 is a perspective view illustrating schematically the adjustment action of the golf ball tee structure in accordance with the present invention.

FIG. 5 illustrates the application of the structure of a rotating golf ball tee. A hand is first to hold the body 1 of the tee structure and the thumb presses onto the rotating connector 11 to insert the fixing leg 10 vertically into the ground. If the elastic arm 3 is not in horizontal with the horizon, the elastic arm 3 can be flipped to the other direction. By slightly adjustment of the difference of position between the compressible section 30 and the non-compressible section 31 of the elastic arm 3, the golf ball is firmly placed on the ball holding seat 4. Thus, the golf ball is in a firm position on the seat 4.

Figure 6:
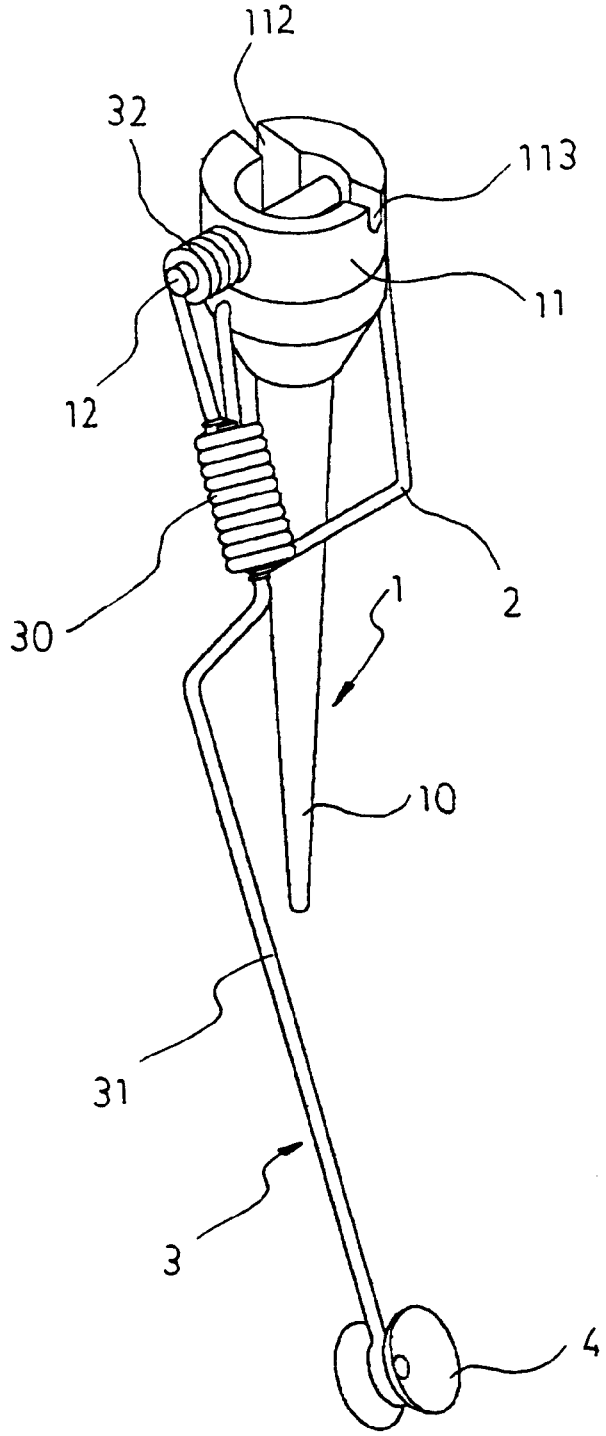
FIG. 6 is a perspective view illustrating the folding of the tee structure of the present invention.

Referring to FIG. 6, there is shown the lifting up of the body 1 after a player has used the tee to place a golf ball for the hitting with a club. Lifting up the lifting ring 2 of the tee structure lifts the tee up and the shaft rod 12 is withdrawn from the connection hole 111 and the elastic arm 3 is taken up. After that, the shaft rod 12 is inserted into the connection hole 111 such that the elastic arm 3 faces downward and is located at one side of the rotating connector 11. Thus, the folding of the body 1 is obtained.

Figure 7:
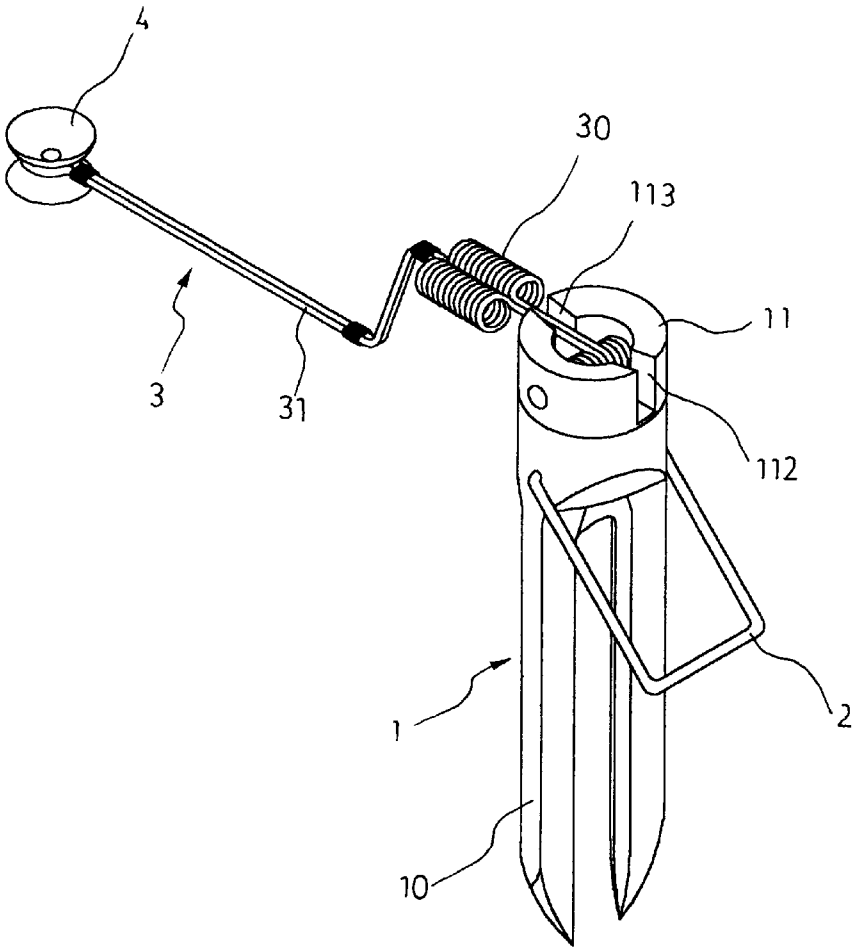
FIGS. 7 to 9 are perspective views showing the tee structure of preferred embodiments in accordance with the present invention.

FIG. 7 is the structure of the structure of a rotating golf ball tee structure of another preferred embodiment of the present invention. There is a plurality of fixing legs 10 provided to the body to facilitate mounting the body 1 into the ground and there is a plurality of elastic compressible sections 30 on the elastic arm 3 to prevent deformation as a result of impact.

Figure 8:
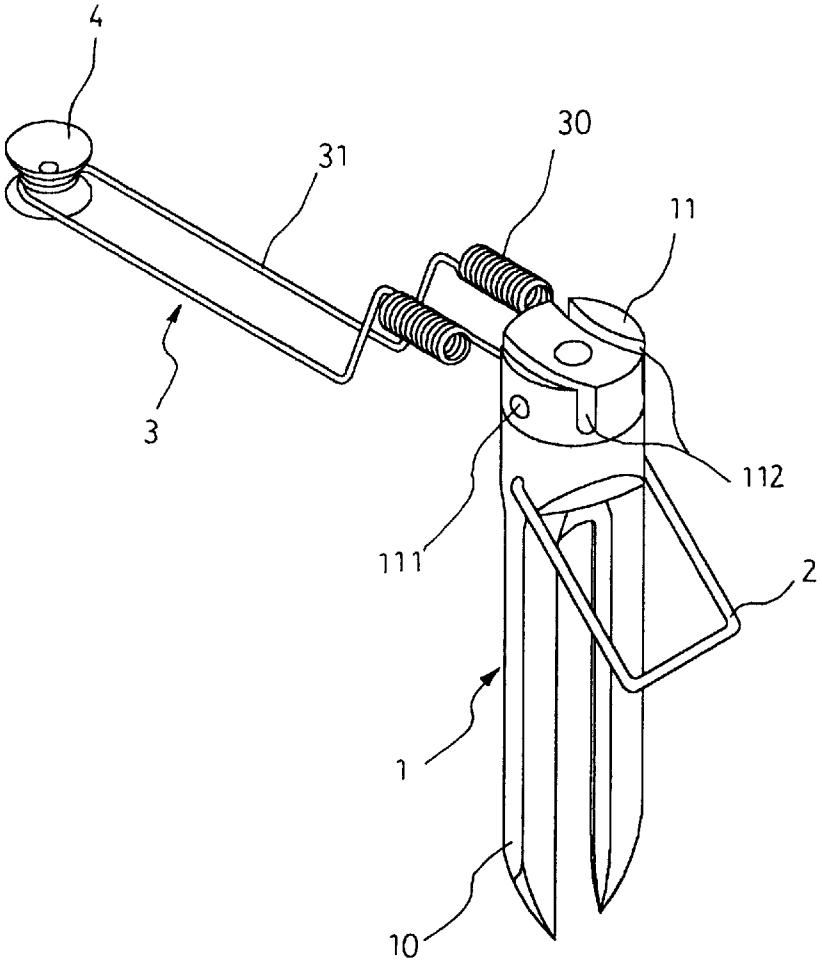

FIG. 8 is another tee structure in accordance with another preferred embodiment of the present invention. There is a plurality of fixing legs 10 and there is a plurality of elastic arms 3 with the compressible section 30 to prevent deformation as a result of impact.

Figure 9:
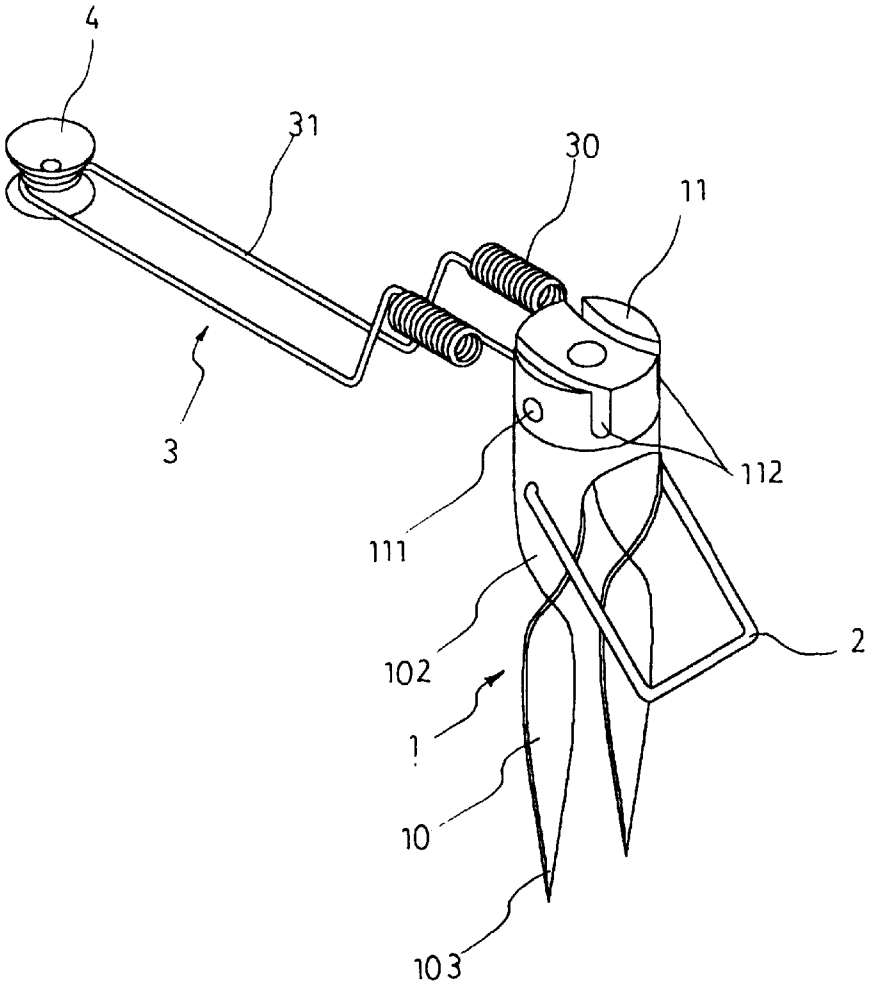

FIG. 9 shows another structure of the fixing leg 10 of the tee structure of the present invention. The top fixing leg 102 and the bottom fixing leg 103 are twisted to become vertical and the legs enable the insertion of the body 1 into the ground with a stronger ground-holding force so as to provide a strong securing to the tee structure with the ground.

Figure 10:
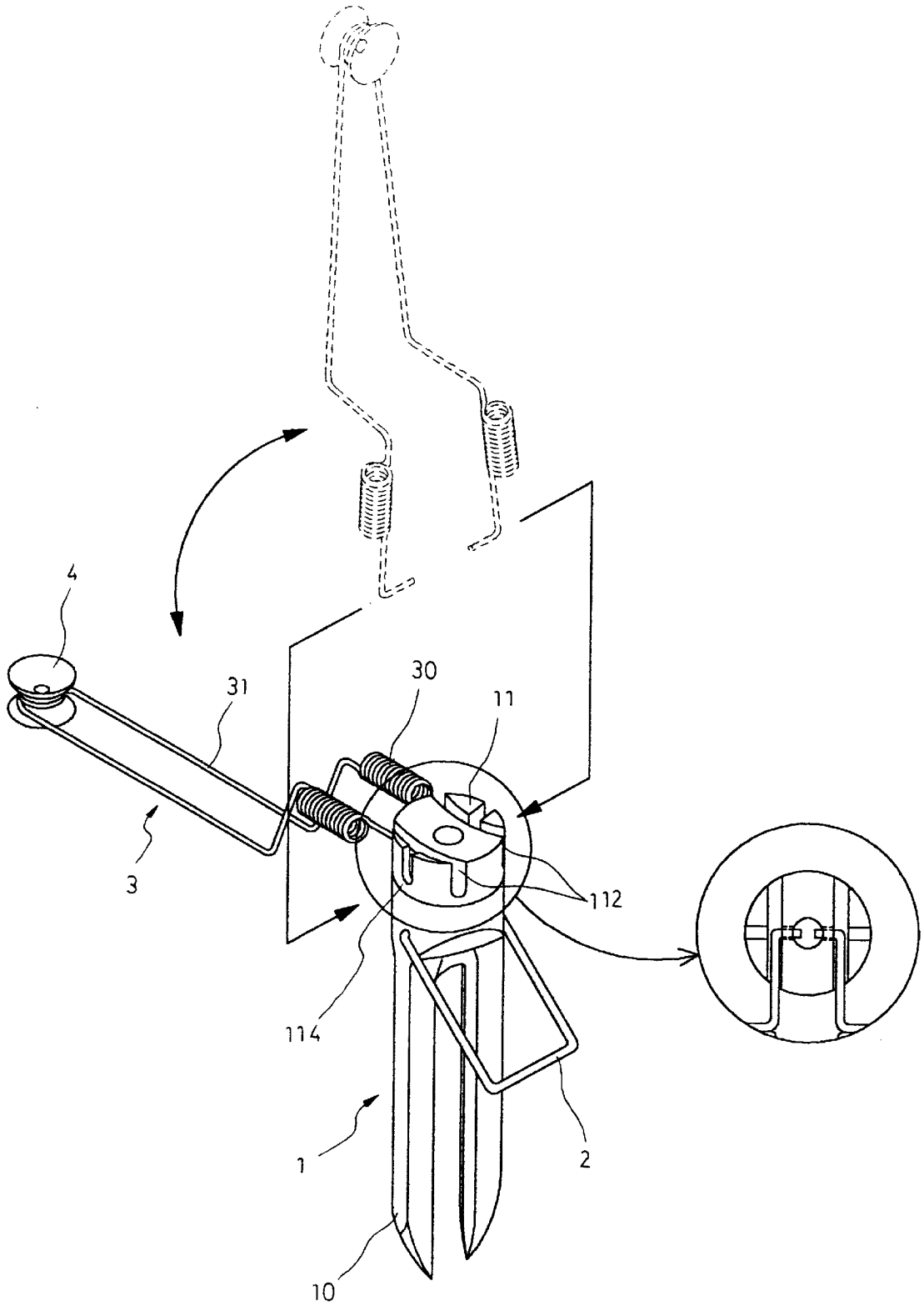
FIG. 10 is a perspective view showing the mounting of an elastic arm of the tee structure in accordance with the present invention.
Figure 11:
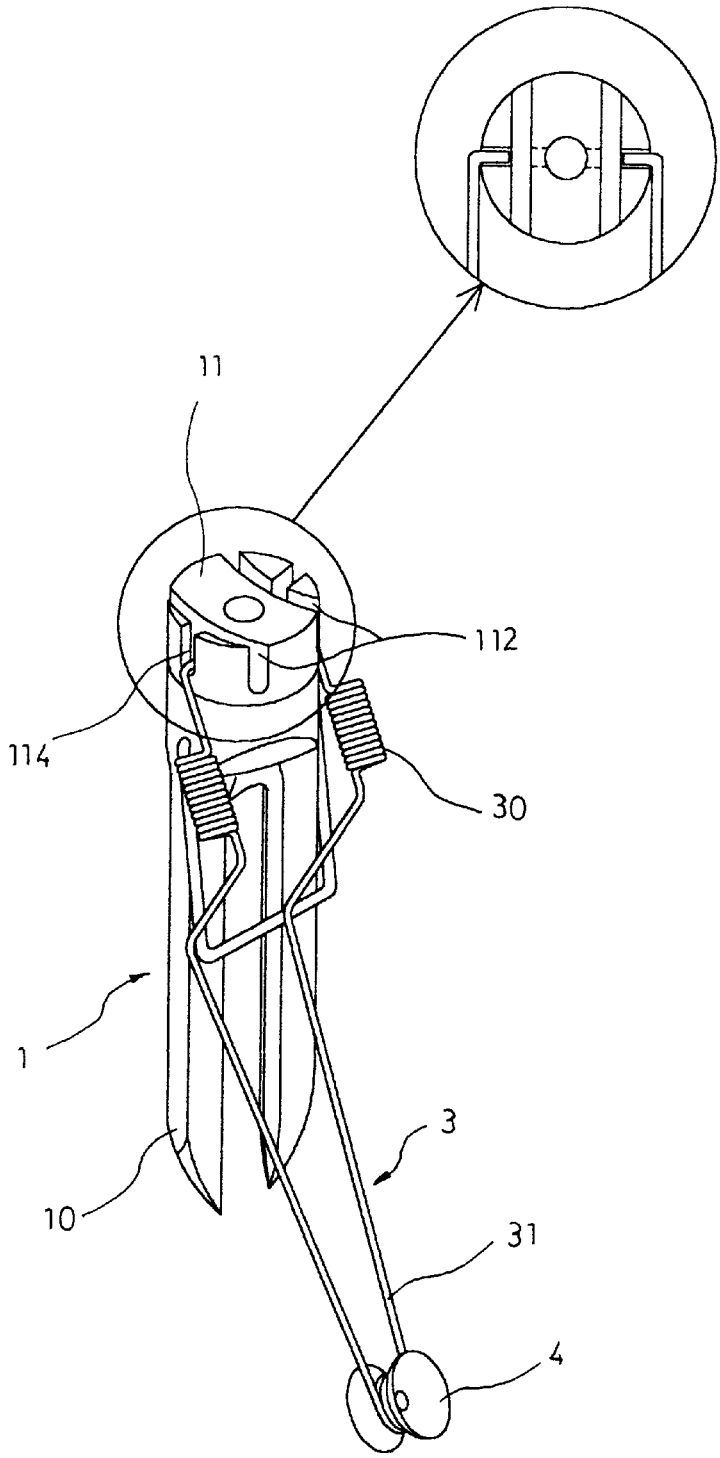
FIG. 11 is a perspective view showing the folding of the elastic arm in FIG. 10 in accordance with the present invention.

As shown in. FIGS. 10 and 11, there is shown another structure of an elastic arm 3 in accordance with the present invention. The rotating connector 11 is provided with a larger notch 112 and a small notch (not shown in FIGS. 10 and 11), allowing the flipping of the elastic arm 3 and at the same time, a notch 114 is provided to correspond to the connection hole (not shown in FIGS. 10 and 11). Thus, the connector ends of the two elastic arms 3 can be inserted to or can be withdrawn from the connection hole at the notch 114. After the end of the elastic arm 3 is withdrawn, it can be clipped at the notch 114. Thus, the elastic arm 3 can be folded downward.

In accordance with the present invention, the tee structure can resist the remaining force of the impact force when a golf club strikes the ball, and can provide a secured positioning effect to the ball. Besides, the tee allows the ball to travel further and can be adjusted to comply with the types of golf clubs utilized by the golfer. Further, the tee is effectively in absorbing the strong reaction force produced at the instance of striking the ball using a golf club. Withdrawing the lifting ring can easily lift the tee up. The small size of the tee facilitates storage and provides convenient carrying.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A rotating tee structure for golf having a body and a rotating connector mounted on the body, wherein an elastic arm having an elastic compressible section is provided on the connector and one end of the elastic arm is mounted with a ball holding seat for the holding of a golf ball, a connection hole is provided on the connector such that a shaft rod can be pivotally mounted at the connection hole, and the shaft rod and the elastic arm are inserted at a mounting section thereof, and a large notch and a small notch are provided on the rotating connector, allowing the elastic arm to be flipped, whereby when the golf ball is struck with a golf club, the elastic arm and the rotating connector absorb the impact force at the instance of ball striking and the golf ball travels further.

2. The tee structure for golf of claim 1, wherein a pivotal hole is provided on a fixing leg of the tee and is engaged with a pivotal connector of a lifting ring.

* * * * *